United States Patent [19]

Ito et al.

[11] Patent Number: 4,476,904

[45] Date of Patent: Oct. 16, 1984

[54] DEVICE FOR MEASURING THE LENGTH OF A WEFT

[75] Inventors: Tetsuo Ito, Kariya; Shingo Oda, Nagoya, both of Japan

[73] Assignee: Kabushiki Kaisha Toyoda Jidoshokki Seisakusho, Kariya, Japan

[21] Appl. No.: 451,739

[22] Filed: Dec. 21, 1982

[30] Foreign Application Priority Data

Dec. 26, 1981 [JP] Japan ..... 56-212723
Dec. 29, 1981 [JP] Japan ..... 56-215885

[51] Int. Cl.[3] ..... D03D 47/36
[52] U.S. Cl. ..... 139/452; 242/47.01
[58] Field of Search ..... 139/452, 450; 242/47.01, 47.12; 66/132

[56] References Cited

U.S. PATENT DOCUMENTS 4,132,370 1/1979 Van Mullekom ..... 424/47.12
4,381,807 5/1983 Umezawa et al. ..... 139/452
4,444,226 4/1984 Ichikawa et al. ..... 139/452

FOREIGN PATENT DOCUMENTS 1042868 9/1966 United Kingdom ..... 139/452

*Primary Examiner*—James Kee Chi
*Attorney, Agent, or Firm*—Brooks, Haidt, Haffner & Delahunty

[57] ABSTRACT

A device for measuring a weft, particularly a drum type weft length measuring device for shuttleless looms is disclosed. The device is provided with a length measuring drum for coilingly winding a weft supplied from a weft supply bobbin and a pair of weft engaging pins for controlling a winding amount of the weft on the drum and a shift of the wound weft towards the weft drawing-out direction. The weft engaging pins are linearly movable in their own axial directions for protruding from and retracting into the drum, alternately. These protruding and retracting positions are shiftable in the axial direction of the drum.

10 Claims, 6 Drawing Figures

DEVICE FOR MEASURING THE LENGTH OF A WEFT

FIELD OF THE INVENTION

This invention relates to a device for measuring the length of a weft and more particularly to a drum type weft length measuring device for shuttleless looms.

BACKGROUND OF THE INVENTION

Normally in a shuttleless loom particularly in a jet loom, a weft length measuring device is provided to preliminarily measure a necessary length of the weft needed for one weft inserting operation and store the weft. As for such kind of weft length measuring device, conventionally available in the prior art was a so-called pipe type weft length measuring device in which the weft was stored in a storage pipe while being floated in airflow. In this pipe type weft length measuring device, however, the weft is subjected to relatively large resistance when it is drawn out from the storage pipe by the airflow upon the weft inserting. Furthermore, the weft is inserted in the storage pipe also by the airflow. Consequently, it was difficult to store an exact length of weft needed for one insertion. As a result, the weft inserting operation became unstable and improper-insertion often occurred, which was deemed a drawback of the prior system. In order to obviate the drawbacks of said pipe type weft length measuring device, a new drum type weft length measuring device is proposed in which a weft supplied from a weft supply bobbin is continuously wound up on the tapered surface of a weft storage drum, in a coiled form and the thus wound weft is drawn out upon the weft inserting. On this weft length measuring device, equipped is a pair of weft engaging pins, which control the wound amount of the weft and its out-feeding, in a retractable manner relating to the tapered periphery of the weft storage drum.

Said weft engaging pins mounted on the drum type weft length measuring device of the prior art have a structure such that the pins can turnably move around a plane perpendicular to the axial line of the drum. Therefore, when a weft is coiled on the tapered surface of the drum, the first turn of the weft is engaged status until very instant when said weft engaging pin disappears in the drum. Accordingly, the second and later turns of the weft tend to run over the first turn and to move toward the drawing-out direction. In consequence, there is a disadvantage that the weft is often entangled disturbing the weft inserting operation. On the drum, on the other hand, there are long holes extending in the peripheral direction of the drum, to permit said weft engaging pins to appear on and disappear in the drum. The first turn of the weft located close to the long holes lies more towards the inner side of the drum than the weft of the second and turns on the drum. Therefore, at an instant when said weft engaging pin is retracted in the drum, the second and later turns of the weft are apt to run over the weft of the first turn. It easily causes entanglement of the weft which is troublesome to the weft inserting operation.

Also, in the drum type weft length measuring device of the prior art as described above, a pair of weft engaging pins are mounted in the axial direction of the drum in an alternately retractable manner relating to the drum periphery of the weft storage drum. Out of these weft engaging pins, one pin mounted on the weft winding tube is protruded when a necessary length of the weft is wound on the drum for one insertion, while working to separate securely the weft readily wound from the weft to be newly wound. The other pin located on the drawing-out side, works to restrict, when one pin disappears in the drum during winding a necessary length of the weft for one insertion, the weft wound so far to move toward the drawing-out side, thus ensuring a completion of winding another necessary length of the weft for the next insertion. Consequently, said one pin shall be protruded and retracted on a position allowing secure separation of the weft. In addition, it is also another important factor to keep a suitable spacing between the positions of both pins. In other words, in order that one pin can securely separate the weft, the other pin should be distantly mounted because the weft wound on the drum can move in a larger distance. On the other hand, however, if the other pin is located too far from one pin while permitting the wound weft to move by a long distance, the weft may be slackened causing possibly entanglement and a trouble in the weft inserting function. As described above, the spacing of retract positions of two weft engaging pins become a very important matter.

However, according to the method of the prior art, weft engaging pins take fixed distance therebetween once they are set to engage the weft. Therefore, it was a disadvantage of the prior system that the foregoing problem was not satisfactorily solved.

OBJECT OF THE INVENTION

According to the scope of a weft length measuring device of the present invention, two weft engaging pins are retractively moved linearly on the drum and, while still maintaining the winding pitch of the weft wound on said drum in a coiled form, said weft can be moved smoothly in drawing-out direction, without harming the function of weft inserting operation.

According to another purpose of the present invention, a weft length measuring device is realized that can ensure a firm, linear operation of two weft engaging pins by guiding it with a guide means.

It is still another object of the invention to offer such a weft length measuring device that the spacing between retract positions of two weft engaging pins is adjustable to optimum values, even when operating conditions of a loom are changed, e.g. weaving width, kind of weft, etc., by making the retract positions of two weft engaging pins movable in the axial direction of the drum.

According to a further object of the invention, such a weft length measuring device is made available that the retract positions of the weft engaging pins can be very easily adjusted.

Moreover, other features and objects of the present invention will be clearly understood from the embodiments to be described in the following and their scope will be clarified in the claims for a patent. In addition, many other advantages and features of the present invention would be recalled by every person skilled in the state of the art, although not obviously described in the patent specification.

DETAILED DESCRIPTIONS OF THE PREFERRED EMBODIMENTS

Figure 1:
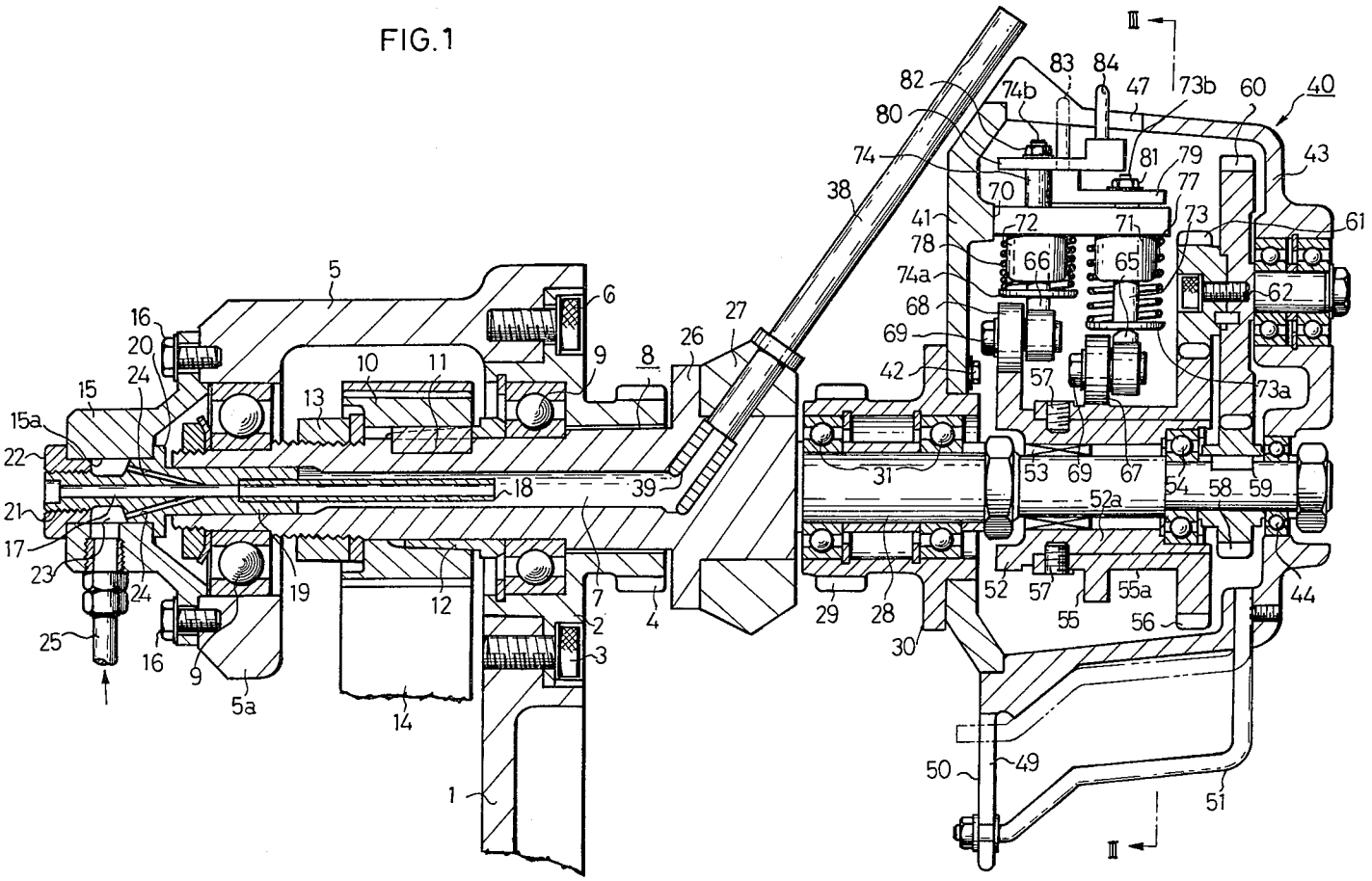
FIG. 1 is a cross section of the weft length measuring device embodied according to the present invention.

Referring to the drawings, an embodiment of the present invention is described: On a frame 1 located on the machine side of a loom, a bracket 2 is fixed with bolts 3 and, on its front side (right hand side of FIG. 1) is integrally formed a gear 4. On the top of the bracket 2, a supporting arm 5 having a drooping part 5*a* opposite to the bracket 2 is fixed with bolts 6. A rotatable support spindle 8 is provided with a weft guiding hole 7 in its spindle center and supported rotatably through bearings 9 between said bracket 2 and the drooping part 5*a* of the supporting arm 5. Between the bracket 2 and drooping part 5*a*, a toothed pulley 10 is fixed on the rotatable support spindle 8 by means of a key 11, taper bush 12 and nut 13. Said toothed pulley 10 is rotated by a timing belt 14 driven synchronously with the looming operation.

Behind the drooping part 5*a* of said supporting arm 5, a supporting bracket 15 having engaging hole 15*a* is fixed with a bolt 16 to the dropping part 5*a*. An airblow nozzle has a weft inserting bore 17 at the axial center thereof and an accelerating tube 18 on the end part thereof. Its end part is received revolvably in the weft guiding hole 7 of said rotatable support spindle 8. In the vicinity of the center of the airblow nozzle 19, a flange part 20 is formed, the base end of which is manufactured with a small diameter and formed with a male thread 21. Then, said airblow nozzle 19 is loosely coupled with said supporting bracket 15 by the aid of an engaging hole 15*a*. The flange portion 20 is held against said supporting bracket 15 by means of a threaded nut 22 tightened in abutting relation on its opposite end surface. On the airblow nozzle 19 is formed a plurality of air supply holes 24 connecting an annular space 23 to the weft inserting hole 17. The space 23 is enclosed by the outer surface of the base end of the airblow nozzle 19 and said engaging hole 15*a* and the front end of the nut 22. On the lower part of said supporting bracket 15, there is provided a compressed air supply tube 25 communicating with said space 23.

Figure 2:
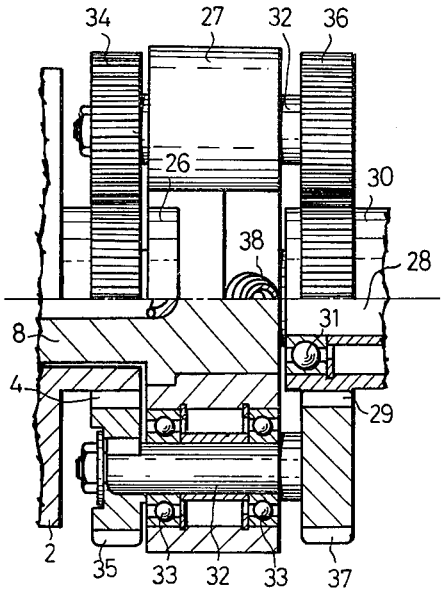
FIG. 2 is a partially exploded plan showing a planet gear mechanism for the weft length measuring device as disclosed in FIG. 1.

A flange 26 is formed on a middle part of the rotatable support spindle 8. On said flange 26, pressingly fixed is a long, horizontally extending supporting means 27 as shown in FIG. 2. On the base end of the top axis 28 of the rotatable support spindle 8, a bracket 30 integrally formed with a gear 29 is supported by bearings 31 and coupled with the top shaft 28. On both sides of said supporting means 27 referring to FIG. 2, a pair of revolving axes 32 extending in the axial direction of the rotatable support spindle is supported revolutionally by bearings 33. On both ends of two revolving axes 32 are fixed two pairs of planet gears 34, 35, 36 and 37 which engages, respectively, with said gears 4, 29 working as sun gears. Then, when the rotatable support spindle 8 revolves, the supporting means 27 rotates and planet gears 34, 35, 36 and 37 revolve while being engaged with sun gears 4, 29, respectively. Even in this case, the gear 29 shall be held static. In order to achieve this condition the, same number of gear teeth are formed on both gears 4 and 29. Also the, numbers of gear teeth are made the same for planet gears 34, 35, 36 and 37. In addition, on the supporting means 27, a weft winding tube 38 is fixed to communicate with the weft leading hole 7 of the rotatable support spindle 8, in an obliquely penetrating manner. On its base end is mounted a weft guide 39 comprising abrasion-resistive ceramics.

Figure 4:
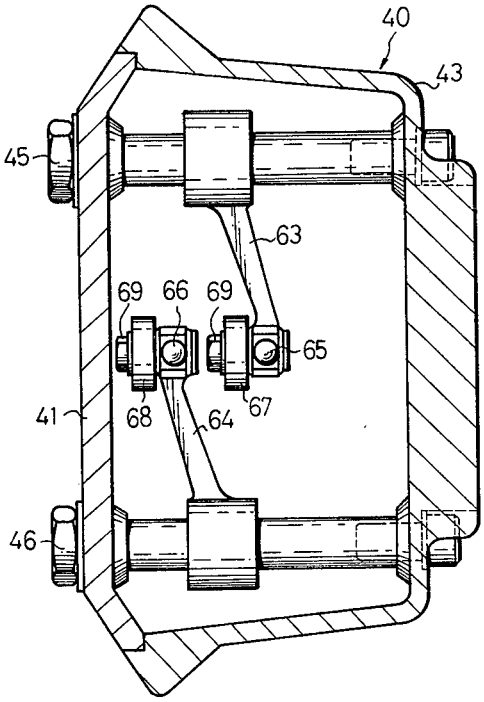
FIG. 4 is a cross section showing a pair of arms supporting a pair of weft engaging pins, although partially omitted.
Figure 3:
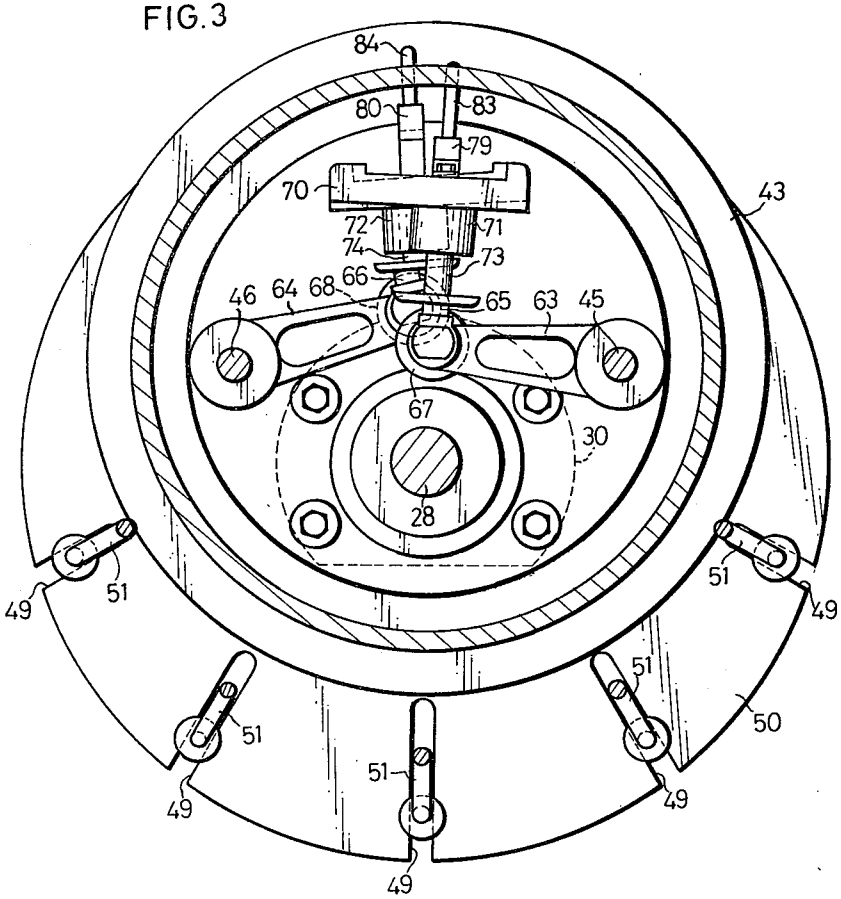
FIG. 3 is a section taken along the line III—III of FIG. 1.

On the front side of said bracket 30, a long, horizontal drum 40 is fixed by means of bolts 42, on which the weft from the weft winding tube 38 is wound. On the head of the top shaft 28, the peripheral wall surface 43 of the length measuring drum 40 is supported rotatingly by means of a bearing 44. Side wall surfaces 41 and 43 are fixed to each other by a pair of tightening bolts 45, 46, as shown in FIG. 4. On the upper side of the peripheral wall surface 43, two grooves 47, 48 are formed perpendicularly to the circumferential direction, referring to FIG. 6. As shown in FIG. 3, integrally and protrudingly mounted is a flange 50 having a plurality of guide slots 49. On each guide slot 49, a weft winding rod 51 is mounted in adjustably shiftable manner to permit a change of weft measuring length, as the weft is to be wound on the length measuring drum 40.

On a middle part of the top shaft 28, the first cam 52 is supported on its supporting cylinder portion 52*a* by means of bearings 53, 54, in a relatively rotatable state with the shaft 28. The second cam 55 having a gear 56 integrally formed with a supporting cylinder 55*a* is fixed on the outer periphery of its supporting cylinder 52*a* by pushing screws 57 so as to be rotatable together with the first cam 52. On the head portion of the top shaft 28, a gear 58 is engaged rotatably by and with a key 59. On the peripheral wall surface 43, a gear 60 is revolvingly assembled by a bearing, the gear 60 having larger diameter than the gear 58 to be mated by the gear 60. A gear 61 is mounted on said gear 60 with a bolt 62, the gear 61 engaging with said gear 56. Then, when the gear 58 revolves together with the top shaft 28, the gear 56 rotates with the gear 58 by way of gears 60, 61, thus revolving said first and second cams 52, 55 which revolve as a body, according to the structure of the present invention.

The fixing bolts 45, 46 fix the side wall surfaces 41, 43 of the length measuring drum 40, in one assembly. On said fixing bolts 45, 46, arms 63, 64 are rotatably supported as shown in FIGS. 3, 4. On the end part of each arm, push-up pins 65, 66 are fixed. In addition, bearings 68, 67 are fixed by means of bolts 69, serving as cam followers, while contacting with the first and second cams 52, 55.

Figure 5:
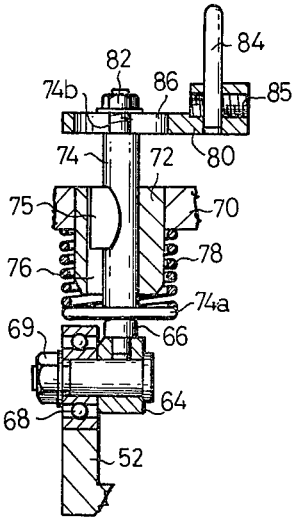
FIG. 5 is a partially enlarged side elevation showing the supporting condition of one of the weft engaging pins.

In the inside top of the side wall surface portion 41, referring to FIG. 1, a supporting bracket 70 is protrudingly mounted. Further, two guide cylinders 71, 72 are mounted perpendicularly to the outer periphery of the length measuring drum 40, in the supporting bracket 70. On the both guide cylinders 71, 72, rods 73, 74 are slidably engaged. On the upper and lower portions of said rods 73, 74 are engaging plates 73*a*, 74*a* and male threads 73*b*, 74*b*, respectively, in an integral manner. Referring to FIG. 5, a pair of keys 75 (only one is shown) are fixed on the rods 73, 74, respectively. Each key 75 is engaged in a corresponding key-way 76 formed within the respective guide cylinders 71, 72, thus preventing rotation of the rods and serving as a guide for their rectilinear movement. Also, on the outer periphery of the guide cylinders 71, 72 are mounted compression coil springs 77, 78 which bias the rods 73, 74 in the radial direction of the length measuring drum, through engaging plates 73*a*, 74*a*.

On the ends of rods 73, 74, mounting bars 79, 80 extend perpendicularly to rods 73, 74, and are connected thereto by means of nuts 81, 82, respectively. On said mounting bars 79, 80, a pair of weft engaging pins 83, 84 are fixed, respectively, as shown in FIG. 5, on the peripheral wall surface 43 of the length measuring drum 40, in order to control the winding amount of the weft on the length measuring drum and the shift of the wound weft toward the drawing-out direction, by means of a pushing screw 85. Long holes 86 are formed on the mounting bars 79, 80, as shown in FIG. 5, in the axial direction of the length measuring drum 40. The male threads 73*b*, 74*b* of the rods 73, 74 are engaged in the long holes 86 and tightened with nuts 81, 82 for fixing. Their fixing positions are made adjustable relating to the axial direction of the length measuring drum 40. One weft engaging pin 84 is retracted in the peripheral wall surface 43 during the weft inserting operation. The other weft engaging pin 83 is protruded at the same time from the peripheral wall surface 43. The pin 84 is located closer to the drawing-out side of the weft than the pin 83 (right hand side of FIG. 1.).

In the meantime, the first and second cams 52 and 55 are formed at their cam surfaces in such manner that, when these cams revolve one turn, said two weft engaging pins 83, 84 are alternatingly appearing and disappearing once on and in the peripheral wall surface 43. In other words, both cam plates 52, 55 have portions of large and small diameters, respectively. Referring to FIG. 1, when the large diameter portion of the first cam 52 is in contact with the bearing 68 supported by the end of the arm 64, the small diameter portion of the second cam 55 contacts the bearing 67 carried by the top of the arm 63.

The weft length measuring device of the present invention operates as follows.

For starting the operation of this weft length measuring device, the weft engaging pin 84 is set on a protruding position from the peripheral wall surface 43 as shown in FIG. 1, as the pin is located on the drawing-out side of the length measuring drum 40. Then, a weft is supplied from a weft supply bobbin (not illustrated) up to the outlet of the weft winding tube 38 through the weft inserting hole 17 of the airblow nozzle 19, and the weft guiding hole 7 of the rotatable support spindle 8. Then, the weft is wound up on the length measuring drum 40 by a predetermined number of turns. Thereafter, the weft is led down to a weft inserting means (not illustrated), thus setting is completed. In a device of this embodiment, the weft is conveyed, while floating on the air blown from the airblow nozzle 19, up to the outlet of the weft winding tube 38. Therefore, the foregoing weft leading is carried out very easily.

Upon starting of operation of the loom on the above condition, the toothed pulley 10 is rotated by the timing belt 14 synchronously driven with the weaving operation, and the support spindle 8 is also rotated together with the toothed pulley 10 by the key 11. The rotation of the support spindle 8 causes the supporting means 27 to rotate therewith. Thus, the planet gears 34, 35, 36, and 37, which are supported by the supporting means 27, are revolved around said gears 4, 29 while being engaged with them. The number of gear teeth of each of the planet gears 34, 35, 36 and 37 is made the same, and the same number of gear teeth is employed in the gears 4, 29. Accordingly, even where the planet gears 34, 35, 36 and 37 turn around the sun gears 4, 29, the gear 29 is always kept stationary. Consequently, the length measuring drum 40 is retained in static condition although the rotatable support spindle 8 revolves, since the drum 40 is fixed on the bracket 30 formed integrally with the gear 29. On the other hand, the weft winding tube 38 fixed on the supporting means 27 rotates together with the rotatable support spindle 8, so that its end revolves around the length measuring drum 40, during which the weft is wound up on the length measuring drum 40.

On the other hand, upon the rotation of support spindle 8, the gear 58 is rotated together with the rotatable support spindle 8, said gear 58 being fixed on its top shaft 28 through the key 59. In addition, the first and second cams 52, 55 integrally turn around the top shaft 28 with a speed reduced from the revolving speed of the rotatable support spindle 8, since the gear 60 is engaged with the gear 58 and the gear 61 is fixed on said gear 60 and the gear 56 engages the gear 61, all of which work to transmit revolution to said cams 52, 55. Said weft winding tube 38 has such a structure that, at the interval between two successive weft inserting operations, the tube 38 revolves by several turns to wind a necessary length of the weft for one inserting operation onto the length measuring drum 40. Also, said first and second cams 52, 55 are prepared to complete one turn in the meantime, with speed reduction by means of said gears 56, 58, 60, 61.

FIG. 1 relates to a condition that one weft engaging pin 84 is protruded out of the peripheral wall surface 43 and weft is being wound. Then, the operation continues while the first cam 52 and the second cam 55 turn and a contact between the small diameter part of the second cam 55 and the bearing 67 supported by the arm 63 is completed. Then, the arm 63 starts to turn clockwise as shown in FIG. 3 and to push up the rod 73 being driven by the push-up pin 65 against the force of the compressive spring 77. Thus, when the large diameter portion of the second cam 55 becomes in contact with the bearing 67, pushing-up operation is completed. At that time, the other weft engaging pin 83 takes a protruding condition outside the peripheral wall surface 43, apart from the previous condition where it was disappeared in the peripheral wall surface 43 as shown in FIG. 1, because said weft engaging pin 83 is attached to one end of the rod 73 through the mounting bar 79. In this condition, said weft engaging pin 83 works to securely separate the weft to be wound thereafter by the weft winding tube 38 from the weft previously wound up on the length measuring drum. Thus, between both weft engaging pins 83, 84, completely and readily wound up is a necessary length of weft for one time insertion.

When the first cam 52 and the second cam 55 further turn and a contact between the large diameter portion of the first cam 52 and the bearing 68 supported by the arm 64 comes to an end, the rod 74 is pushed down along the guide cylinder 72 downward. Consequently, the other weft engaging pin 84 starts to disappear vertically in the peripheral wall surface 43, apart from the previous condition that said pin 84 was held protruding. At a time when the small diameter portion of the first cam 52 comes into a contact with said bearing 68, one weft engaging pin 84 is completely disappeared in the peripheral wall surface 43. Immediately after that, weft inserting operation starts in which the weft is inserted by a weft inserting device (not illustrated), while the weft wound between the weft engaging pins 83, 84 is being drawn out. The other weft engaging pin 83 is located on the side of the weft winding tube 38 and held still protruding even during the weft inserting operation, while restricting the movement of the winding weft toward the drawing-out side, by means of the weft winding tube 38.

After completion of one weft inserting operation, the weft readily wound forward of said other weft engaging pin 83 is completely drawn out. When the first cam 52 and the second cam 55 revolve in continuation, the large diameter portion of the first cam 52 comes into contact again with said bearing 68, while the arm 64 is being turned counterclockwise of FIG. 3. Thus, by means of the push-up pin 66, the rod 74 is pushed up along the guide cylinder 72 against the force of the compressive spring 78. Then, the other weft engaging pin 84 is protruded out of the peripheral wall surface 43. Thereafter, the small diameter portion of the second cam 55 comes into contact with said bearing 67 wherefrom the rod 73 is pushed down by the compressive spring 77 and the other weft engaging pin 83 completely disappears in the peripheral wall surface 43. And, the weft, previously wound up on the weft engaging drum 40 under a condition that the weft engaging pin 83 restricted weft movement to the drawing-out side, moves to the drawing-out side while being restricted by said weft engaging pin 84 protruding from the surface 43. Later operations are repeated in a completely same manner as those mentioned above, where both weft engaging pins 83, 84 take appearing and disappearing operations to measure the length of and insert the weft.

Both weft engaging pins 83, 84 are mounted on the rods 73, 74 by the mounting bars 79, 80, said rods 73, 74 sliding in the fixed guides 71, 72. Therefore, said weft engaging pins 83, 84 appear on and disappear in the peripheral wall surface 43 taking linear motion. In the prior art, however, pins were operated by a rotary motion along circumferential direction for the retractable operations. Therefore, the provision of the present invention is completely different from the prior art in a remarkable point that the first turn of the weft engaged on the weft engaging pins 83, 84 is really held until the very instant when the weft engaging pins 83, 84 disappear in the peripheral wall surface 43, and the second and later turns of the weft never run over the first turn of the weft to move toward the drawing-out side so that possible entanglement of the weft is eliminated.

Figure 6:
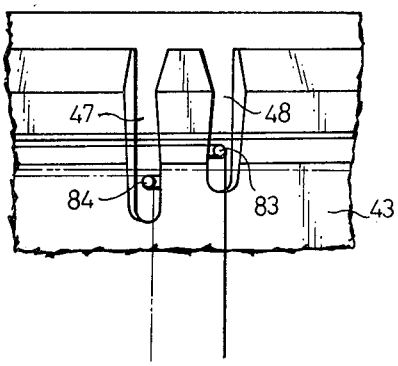
FIG. 6 is a partial plan illustrating the retract positions of a pair of weft engaging pins on the drum.

Also, the slots 47, 48 serve to guide the weft engaging pins 83, 84 to appear on and disappear in the peripheral wall surface 43 by linear motion. The widths of said slots 47, 48 are made sufficiently narrow in the circumferential direction of the length measuring drum 40. Therefore, as shown in FIG. 6, it is formed to extend substantially in the axial direction of the length measuring drum 40. Consequently, it never occurs that the first turn of the weft engaged with the weft engaging pins 83, 84 be positioned on a position inner than the second and onward turns of the weft, in relation to the peripheral wall surface 43. Moreover, in actual operation, the weft is first wound on the periphery of the length measuring drum 40 under the restriction of a movement toward the weft drawing-out side by the weft engaging pins 83, 84 and then, the weft smoothly moves to the weft drawing-out side while retaining its winding pitch as soon as the weft engaging pins disappear in the peripheral wall surface 43.

Also, the appearing and disappearing positions of both weft engaging pins 83, 84 take a close relationship with the weft inserting function, because said pins 83, 84 control the amount of winding of the weft on the length measuring drum 40 and the shift of the weft to the drawing-out side. In this embodiment, the appearing and disappearing positions of the weft engaging pins 83, 84 can be controlled by a very easy operation that, after loosening the nuts 81, 82 which are working to tighten and fix the mounting bars 79, 80 on the rods 73, 74 while the weft engaging pins 83, 84 are fixed on said bars 79, 80, said mounting bars 79, 80 are moved along their long holes 86 and then, the nuts 81, 82 are tightened again.

In this embodiment, a plurality of weft winding rods 51 is mounted on the lower side of the peripheral wall surface 43 in an independently movable and adjustable manner. Therefore, whenever changing weaving width, etc., winding length on the length measuring drum 40 can be easily set corresponding to the new value in accordance with changing of fixing positions of the weft winding rods 51.

It is obvious that a wide variety of embodiments can be constituted without destroying the principle and scope of the present invention. Accordingly, the present invention is not limited by any particular embodiment unless it is limitingly stated in the attached claims.

For example, possibly there is a modification that the weft engaging pins 83, 84 are directly driven by the first cam 52 and the second cam 55, without the aid of the arm 63, 64. Further, in order to hold the length measuring drum 40 in a static state, magnet or weight suspension may be employed instead of using planet gear mechanism. Or in another possible layout, weft may be wound by turning the length measuring drum 40 while retaining the weft winding tube 38 in a static condition, which is a completely reverse arrangement to the above embodiment. Furthermore, a guide means of the linear motion of the weft engaging pins 83, 84 is not necessarily required to be inside the length measuring drum 40, but said means may be mounted as bushings in the slots 47, 48 where the weft engaging pins 83, 84 are appearing on and disappearing in the peripheral wall surface 43 of the length measuring drum 40, while maintaining a slight gap around both pins 83, 84. In this case, there is efficacy that weft dust on the drum 40 is prevented to enter in the drum 40.

What we claim is:

1. A device for measuing the length of a weft, comprising a length measuring drum for coilingly winding the weft supplied from a weft supply bobbin through a weft guide means, a pair of weft engaging pins mounted substantially within said drum in axially spaced apart relation with respect to the axis of said drum and for retracting and protruding movement through the periphery of said drum for controlling a winding amount of the weft onto said drum and a shift of the wound weft towards the weft drawing-out direction of said drum, a cam mechanism for alternately protruding and retracting said weft engaging pins through the periphery of said drum, and a guide means arranged between said cam mechanism and said weft engaging pins, said guide means for controlling said weft engaging pins so that they move only rectilinearly in their axial directions.

2. The device as set forth in claim 1, wherein said length measuring drum is retained stationary and the end of the weft guide means is rotatable along the outer periphery of said length measuring drum.

3. The device as set forth in claim 1, wherein said guide means comprises mounting bars mounting the base ends of said weft engaging pins, rods for supporting said mounting bars, and fixed guide cylinders supporting said rods in a guidable manner.

4. The device as set forth in claim 3, wherein said guide cylinders are mounted on a supporting bracket fixed in said drum, and engaging plates are fixed on the bases of said rods and, between said engaging plates and said support bracket, compression springs are provided urging said weft engaging pins in the direction of their retraction into said drum.

5. The device as set forth in claim 4, wherein said cam mechanism comprises a pair of cams, and there is an interlocking means between said rods and said cam mechanism, said interlocking means comprising a pair of cam followers engaging the respective of said pair of cams constituting said cam mechanism, a pair of arms mounted in said drum for reciprocating movement and having respective ends supporting said cam followers, and push-up pins fixed on said ends of said arms respectively in contact with said engaging plates and working to push said rods against said urging of said compression springs.

6. The device as set forth in claim 1, wherein said length measuring drum is rotatable about its center axis and said weft guide means is in fixed position.

7. The device as set forth in claim 1, wherein said guide means is mounted on the periphery of said drum and comprises a bushing means for guiding said weft engaging pins in their said rectilinear motion.

8. A device for measuring the length of a weft, comprising a length measuring drum for coilingly winding the weft supplied from a weft supply bobbin through weft guide means, a pair of weft engaging pins mounted substantially within said drum in axially spaced apart relation with respect to the axis of said drum and for retracting and protruding movement through the periphery of said drum for controlling an amount of weft wound up on said drum and a shift of the weft towards the wound weft drawing-out direction of said drum, a cam mechanism for protruding and retracting said weft engaging pins through the periphery of said drum in an alternating manner, and means mounting said weft engaging pins to permit adjustment of their said spacing apart in the axial direction of said drum.

9. The device as set forth in claim 8, wherein said mounting means comprises a pair of mounting bars each mounting the base end of one said weft engaging pins and having an elongated slot formed therein extending in the axial direction of said drum, and a pair of rods the respective ends of which are inserted in said elongated slots and having means for releasably supporting said mounting bars to permit adjustment of the position of said mounting bars on their said associated rods.

10. The device as set forth in claim 9, wherein each of said rods has male threads formed on the end thereof which is inserted in its said associated mounting bar slot, and respective nuts are engaged with said male threads for releasably fixing said mounting bars on said rods.

* * * * *